US008042485B1

(12) United States Patent
DesNoyer et al.

(10) Patent No.: US 8,042,485 B1
(45) Date of Patent: Oct. 25, 2011

(54) STENT MANDREL FIXTURE AND METHOD FOR COATING STENTS

(75) Inventors: Jessica R. DesNoyer, San Jose, CA (US); Stephen D Pacetti, San Jose, CA (US)

(73) Assignee: Advanced Cardiovascular Systems, Inc., Santa Clara, CA (US)

( * ) Notice: Subject to any disclaimer, the term of this patent is extended or adjusted under 35 U.S.C. 154(b) by 1131 days.

(21) Appl. No.: 10/750,312

(22) Filed: Dec. 30, 2003

(51) Int. Cl.
*B05D 3/00* (2006.01)

(52) U.S. Cl. ..... 118/500; 118/504; 427/2.1

(58) Field of Classification Search ..... 269/52, 269/47; 118/500, DIG. 11; 623/1.11, 1.12; 606/198, 194, 108, 192
See application file for complete search history.

(56) References Cited

U.S. PATENT DOCUMENTS

| | | | | | |
|---|---|---|---|---|---|
| 4,629,563 | A | | 12/1986 | Wrasidlo | 210/500.34 |
| 4,733,665 | A | | 3/1988 | Palmaz | 128/343 |
| 4,762,128 | A | * | 8/1988 | Rosenbluth | 606/192 |
| 4,800,882 | A | | 1/1989 | Gianturco | 128/343 |
| 4,846,791 | A | * | 7/1989 | Hattler et al. | 604/43 |
| 4,886,062 | A | | 12/1989 | Wiktor | 128/343 |
| 4,906,423 | A | | 3/1990 | Frisch | 264/48 |
| 5,037,427 | A | | 8/1991 | Harada et al. | 606/108 |
| 5,171,445 | A | | 12/1992 | Zepf | 210/500.27 |
| 5,188,734 | A | | 2/1993 | Zepf | 210/490 |
| 5,229,045 | A | | 7/1993 | Soldani | 264/41 |
| 5,234,457 | A | | 8/1993 | Andersen | 606/198 |
| 5,389,106 | A | * | 2/1995 | Tower | 623/1.15 |
| 5,537,729 | A | | 7/1996 | Kolobow | 29/527.2 |
| 5,611,775 | A | | 3/1997 | Machold et al. | 604/53 |
| 5,624,411 | A | | 4/1997 | Tuch | 604/265 |
| 5,628,786 | A | | 5/1997 | Banas et al. | 623/1 |
| 5,674,208 | A | * | 10/1997 | Berg et al. | 604/527 |
| 5,772,864 | A | | 6/1998 | Møller et al. | 205/73 |
| 5,788,626 | A | | 8/1998 | Thompson | 600/36 |
| 5,820,917 | A | | 10/1998 | Tuch | 427/2.1 |
| 5,823,996 | A | | 10/1998 | Sparks | 604/96 |
| 5,833,659 | A | | 11/1998 | Kranys | 604/96 |
| 5,855,598 | A | | 1/1999 | Pinchuk | 623/1 |
| 5,865,814 | A | | 2/1999 | Tuch | 604/265 |
| 5,895,407 | A | | 4/1999 | Jayaraman | 606/198 |
| 5,897,911 | A | | 4/1999 | Loeffler | 427/2.25 |
| 5,922,393 | A | | 7/1999 | Jayaraman | 427/2.3 |
| 5,935,135 | A | | 8/1999 | Bramfitt et al. | 606/108 |
| 5,948,018 | A | | 9/1999 | Dereume et al. | 623/1 |
| 6,010,573 | A | | 1/2000 | Bowlin | 118/620 |
| 6,045,899 | A | | 4/2000 | Wang et al. | 428/315.7 |
| 6,056,993 | A | | 5/2000 | Leidner et al. | 427/2.25 |
| 6,059,714 | A | | 5/2000 | Armini et al. | 600/3 |
| 6,120,847 | A | | 9/2000 | Yang et al. | 427/335 |
| 6,126,686 | A | | 10/2000 | Badylak et al. | 623/1.24 |
| 6,153,252 | A | | 11/2000 | Hossainy et al. | 427/2.3 |
| 6,156,373 | A | | 12/2000 | Zhong et al. | 427/2.28 |
| 6,214,115 | B1 | | 4/2001 | Taylor et al. | 118/423 |
| 6,245,099 | B1 | | 6/2001 | Edwin et al. | 623/1.13 |
| 6,258,121 | B1 | | 7/2001 | Yang et al. | 623/1.46 |
| 6,279,368 | B1 | | 8/2001 | Escano et al. | 72/342.1 |
| 6,322,847 | B1 | | 11/2001 | Zhong et al. | 427/2.28 |
| 6,364,903 | B2 | | 4/2002 | Tseng et al. | 623/1.15 |
| 6,387,118 | B1 | | 5/2002 | Hanson | 623/1.11 |
| 6,521,284 | B1 | | 2/2003 | Parsons et al. | 427/2.24 |
| 6,527,863 | B1 | | 3/2003 | Pacetti et al. | 118/500 |
| 6,565,659 | B1 | | 5/2003 | Pacetti et al. | 118/500 |
| 6,572,644 | B1 | | 6/2003 | Moein | 623/1.11 |
| 6,605,154 | B1 | | 8/2003 | Villareal | 118/500 |
| 6,673,154 | B1 | | 1/2004 | Pacetti et al. | 118/500 |
| 6,695,920 | B1 | | 2/2004 | Pacetti et al. | 118/500 |
| 7,083,642 | B2 | * | 8/2006 | Sirhan et al. | 623/1.42 |

* cited by examiner

*Primary Examiner* — Dah-Wei Yuan
*Assistant Examiner* — Charles Capozzi
(74) *Attorney, Agent, or Firm* — Squire, Sanders & Dempsey (US) LLP

(57) ABSTRACT

A stent mandrel support for supporting a stent during the application of a coating substance is provided.

16 Claims, 8 Drawing Sheets

STENT MANDREL FIXTURE AND METHOD FOR COATING STENTS

TECHNICAL FIELD

This invention relates to stent mandrel fixtures or supports used during the process of coating stents.

BACKGROUND

Blood vessel occlusions are commonly treated by mechanically enhancing blood flow in the affected vessels, such as by employing a stent. Stents act as scaffoldings, functioning to physically hold open and, if desired, to expand the wall of affected vessels. Typically stents are capable of being compressed, so that they can be inserted through small lumens via catheters, and then expanded to a larger diameter once they are at the desired location. Examples in the patent literature disclosing stents include U.S. Pat. No. 4,733,665 issued to Palmaz, U.S. Pat. No. 4,800,882 issued to Gianturco, and U.S. Pat. No. 4,886,062 issued to Wiktor.

FIG. 1 illustrates a conventional stent 10 formed from a plurality of struts 12. The plurality of struts 12 are radially expandable and interconnected by connecting elements 14 that are disposed between the adjacent struts 12, leaving lateral openings or gaps 16 between the adjacent struts 12. The struts 12 and the connecting elements 14 define a tubular stent body having an outer, tissue-contacting (abluminal) surface and an inner (luminal) surface.

Stents are used not only for mechanical intervention but also as vehicles for providing pharmacological therapy. Pharmacological therapy can be achieved by medicating the stents. Medicated stents provide for the local administration of a therapeutic substance at the diseased site. Local delivery of a therapeutic substance is a preferred method of treatment because the substance is concentrated at a specific site and thus smaller total levels of medication can be administered in comparison to systemic dosages that often produce adverse or even toxic side effects for the patient.

One method of medicating a stent 10 involves the use of a polymeric carrier coated onto the surface of the stent 10. A composition including a solvent, a polymer dissolved in the solvent, and a therapeutic substance dispersed in the blend is applied to the stent 10 by immersing the stent 10 in the composition or by spraying the composition onto the stent 10. The solvent is allowed to evaporate, leaving on the surfaces a coating of the polymer and the therapeutic substance impregnated in the polymer.

The dipping or spraying of the composition onto the stent can result in a complete coverage of all stent surfaces, i.e., both luminal and abluminal surfaces, with a coating. However, from a therapeutic standpoint, drugs need only be released from the abluminal stent surface, and possibly the sidewalls. Moreover, having a coating on the luminal surface of the stent can have a detrimental impact on the stent's deliverability as well as the coating's mechanical integrity. A polymeric coating can increase the coefficient of friction between the stent and the delivery balloon. Additionally, some polymers have a "sticky" or "tacky" consistency. If the polymeric material either increases the coefficient of friction or adheres to the catheter balloon, the effective release of the stent from the balloon after deflation can be compromised. Adhesive, polymeric stent coatings can also experience extensive balloon sheer damage post-deployment, which could result in a thrombogenic luminal stent surface. Accordingly, there is a need to eliminate or minimize the amount of coating that is applied to the inner surface of the stent. Reducing or eliminating the polymer from the stent luminal surface also means a reduction in total polymer load, which is a desirable goal for optimizing long-term biocompatibility of the device.

A method for preventing the composition from being applied to the inner surface of the stent is by placing the stent over a mandrel that fittingly mates within the inner diameter of the stent. A tubing can be inserted within the stent such that the outer surface of the tubing is in contact with the inner surface of the stent. A tubular mandrel that makes contact with the inner surface of the stent can cause coating defects. A high degree of surface contact between the stent and the supporting apparatus can provide regions in which the liquid composition can flow, wick, and collect as the composition is applied to the stent. As the solvent evaporates, the excess composition hardens to form excess coating at and around the contact points between the stent and the supporting apparatus. Upon removal of the coated stent from the supporting apparatus, the excess coating may stick to the apparatus, thereby removing some of the coating from the stent and leaving bare areas. Alternatively, the excess coating may stick to the stent, thereby leaving excess coating composition as clumps or pools on the struts or webbing between the struts.

Accordingly, there is a tradeoff when the inner surface of the stent is masked in that coating defects such as pools and clumps can be formed on the stent. There is a need for eliminating or at least minimizing the coating that is formed on the inner surface of the stent as well as coating defects that are formed on the stent struts or between the stent struts caused by the high degree of surface contact between the stent and the mandrel. A mandrel design is needed that addresses these concerns.

SUMMARY

A stent mandrel support to support a stent during application of a coating substance to the stent is provided, comprising a first member to contact a first end of the stent; a second member to contact, a second end of the stent; and a third member connecting the first member to the second member and extending through a longitudinal bore of the stent, the third member shaped and/or sized to eliminate or substantially prevent a coating from being formed on a luminal surface of the stent.

A mandrel to support a stent during application of a coating substance to a stent is provided, comprising a member to penetrate at least partially into a longitudinal bore of a stent during the application of a coating substance, the member including outward projecting walls, the length of at least one of the walls being not less than 25% of the length of the stent.

A mandrel to support a stent during the application of a coating composition to the stent is provided, comprising a mandrel body capable of being inserted at least partially into a longitudinal bore of a stent and a spiral wall circumscribing the mandrel body.

A mandrel to support a stent during the application of a coating composition to the stent is provided, comprising a mandrel body capable of being inserted at least partially into a longitudinal bore of a stent, wherein the mandrel body or a segment thereof is defined by a shape selected from the group consisting of configuration 2, 3, 4, 5, 6 or 7—as defined in the detailed description.

A mandrel to support a stent during application of a coating substance to a stent is provided comprising a member to penetrate at least partially into a longitudinal bore of a stent during the application of a coating substance, the member including 3 pairs of opposing parallel sides.

A mandrel to support a stent during application of a coating substance to a stent is provided comprising a member to penetrate at least partially into a longitudinal bore of a stent during the application of a coating substance, the member including 6 non-parallel sides.

A mandrel to support a stent during application of a coating substance to a stent is provided comprising a core section having at least three sides and a wall extending from each of the sides in an outwardly direction.

A mandrel to support a stent during application of a coating substance to a stent is provided comprising a member to penetrate at least partially into a longitudinal bore of a stent during the application of a coating substance, the member including outward projecting walls disposed around the circumference of the mandrel, wherein the wall converge with their neighboring walls at an angle.

A method is also provided to coat a stent using the embodiments of the mandrel of the present invention.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

The following description is provided to enable any person having ordinary skill in the art to make and use the invention, and is provided in the context of a particular application and its requirements. Various modifications to the embodiments will be readily apparent to those skilled in the art, and the generic principles defined herein may be applied to other embodiments and applications without departing from the spirit and scope of the invention. Thus, the present invention is not intended to be limited to the embodiments shown, but is to be accorded the widest scope consistent with the principles, features and teachings disclosed herein.

The embodiment of the invention minimize the surface contact between the stent and the mandrel support so as to reduce or prevent coating defect on the stent. It is believed that the embodiments of the invention can also prevent a coating from being formed on the inner surface of the stent or reduce the amount of coating that is formed on the inner surface of the stent. This reduces the total polymer load on the stent 10, thereby improving long-term biocompatibility and ensuring that most of the coating is on the abluminal surface where it provides the most benefit. Further, problematic interactions between a delivery mechanism (e.g., delivery balloon) and the stent luminal surface are eradicated, thereby increasing the ease of stent deliverability.

Figure 1:
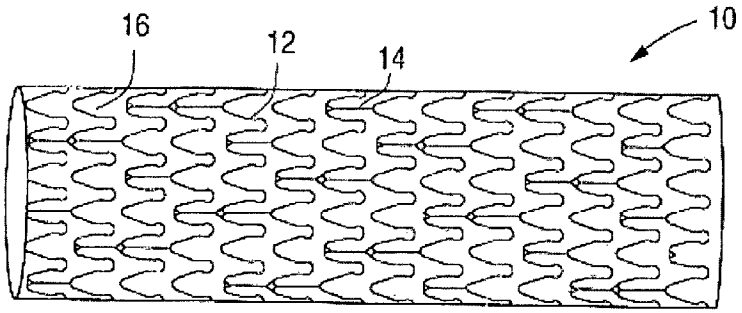
FIG. 1 Prior Art
FIG. 1 illustrates a conventional stent.
Figure 2:
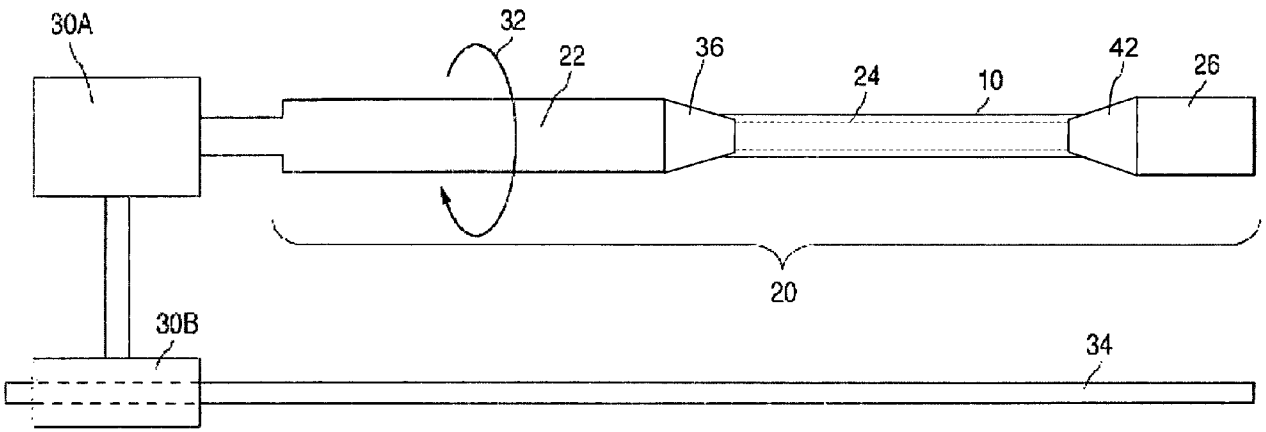
FIG. 2 illustrates a stent mandrel support in accordance with an embodiment of the invention.

FIG. 2 illustrates a stent mandrel support 20 in accordance with an embodiment of the invention. The support 20 for supporting a stent 10 is illustrated to include a support member 22, a mandrel 24, and a lock member 26. The support member 22 can connect to a motor 30A so as to provide rotational motion about the longitudinal axis of the stent 10, as depicted by arrow 32, during a coating process. Another motor 30B can also be provided for moving the support member 22 in a linear direction, back and forth, along a rail 34.

Figure 3A:
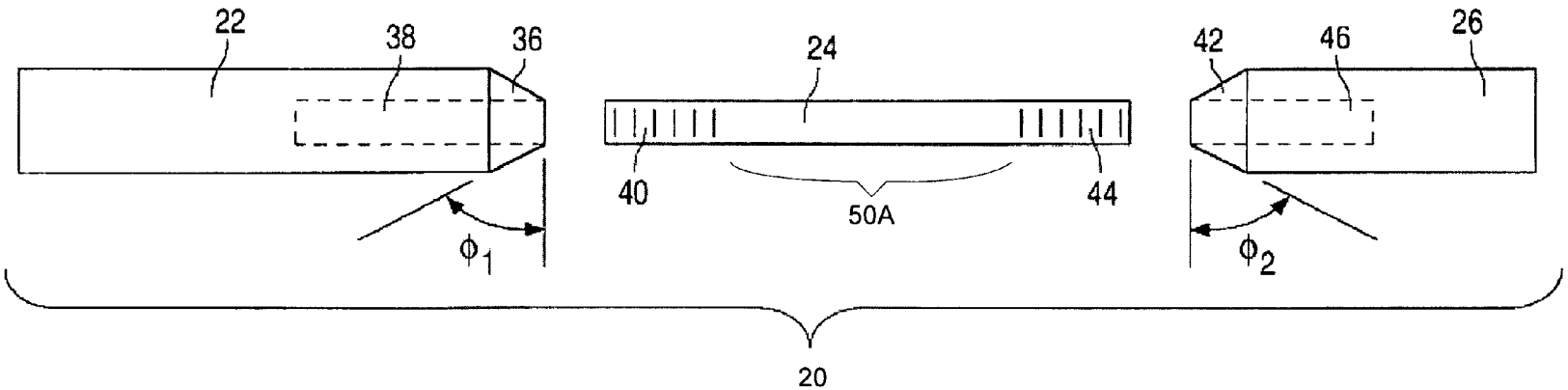
FIG. 3A illustrates a disassembled view of the stent mandrel support of FIG. 2.

FIG. 3A illustrates a disassembled view of the stent mandrel support 20. The support member 22 includes a coning end portion 36, tapering inwardly at an angle $\phi_1$ of about 15° to about 75°, more narrowly from about 30° to about 60°. By way of example, angle $\phi_1$ can be about 45°. The coning end portion 36 supports the stent 10 at one end during a coating process. In accordance with one embodiment of the invention, the mandrel 24 can be permanently affixed to the coning end portion 36. Alternatively, the support member 22 can include a bore 38 for receiving a first end 40 of the mandrel 24. The first end 40 of the mandrel 24 can be threaded to screw into a bore 38 or, alternatively, can be retained within the bore 38 by a friction fit. The bore 38 should be deep enough so as to allow the mandrel 24 to securely mate with the support member 22. The depth of the bore 38 can also be overextended so as to allow a significant length of the mandrel 24 to penetrate or screw into the bore 38. The bore 38 can also extend completely through the support member 22. This would allow the length of the mandrel 24 to be adjusted to accommodate stents of various sizes.

The term inner diameter of stent is defined as the inner diameter of the stent as measured when positioned on the support 20. Accordingly, if the stent is pre-expanded partially when positioned on the support 20, the measurement would be taken in the partial pre-expansion state. The partial pre-expansion of a stent allows for the spaces between the struts to increase, thereby preventing or reducing the formation of "cobwebs." However, it would also allow for the composition to contact the inner surface of the stent. Accordingly, there is a tradeoff when expanding the stent prior to the application of the coating composition.

The outer diameter of the mandrel 24 can be smaller than the inner diameter of the stent 10 so as to prevent the outer surface of the mandrel 24 from making contact with the luminal surface of the stent 10. A sufficient clearance between the outer surface of the mandrel 24 and the luminal surface of the stent 10 should be provided to prevent the mandrel 24 from obstructing the pattern of the stent body during the coating process. However, the outer diameter of the mandrel 24 should also be large enough to substantially shield the luminal surface of the stent 10 from spray coating. In other words, spray that would normally pass through the abluminal surface of the stent 10 and impact the luminal surface of the stent 10 will instead impact and coat the mandrel 24, as will be discussed in further detail below in conjunction with FIG. 4A-FIG. 10C.

The lock member 26 includes a coning end portion 42 having an inwardly tapered angle $\phi_2$. Angle $\phi_2$ can be the same as or different than the above-described angle $\phi_1$. The coning end portion 42 supports the stent 10 at a second end during a coating process. A second end 44 of the mandrel 24 can be permanently affixed to the lock member 26 if the end 40 is disengagable from the support member 22. Alternatively, in accordance with another embodiment, the mandrel 24 can have a threaded second end 44 for screwing into a bore 46 of the lock member 26. The bore 46 can be of any suitable depth that would allow the lock member 26 to be incrementally moved closer to the support member 22. The bore 46 can also extend completely through the lock member 26. Accordingly, stents 10 of any length can be securely pinched between the support and the lock members 22 and 26. In accordance with yet another embodiment, a non-threaded second end 44 and bore 46 combination is employed such that the second end 44 can be press-fitted or friction-fitted within the bore 46 to prevent movement of the stent 10 on the stent mandrel support 20.

In order to reduce coating defects at the point of contact between the stent 10 and the ends 36 and 42, the ends 36 and 42 may be coated with or made of one or more polymeric materials having less adhesive force with the coating substance than the coating substance with the stent. Examples of suitable polymeric materials include poly (tetrafluor ethylene) (e.g., Teflon®), fluorinated ethylene propylene, poly (vinylidene fluoride), poly (para-xylyene), polyamide (Nylon), polyolefins (e.g., high density poly (ethylene) and poly (propylene)), and polyacetal (DELRIN®). Of course the material used depends on the composition that is applied to the stent and the material from which the stent is made.

Figure 3B:
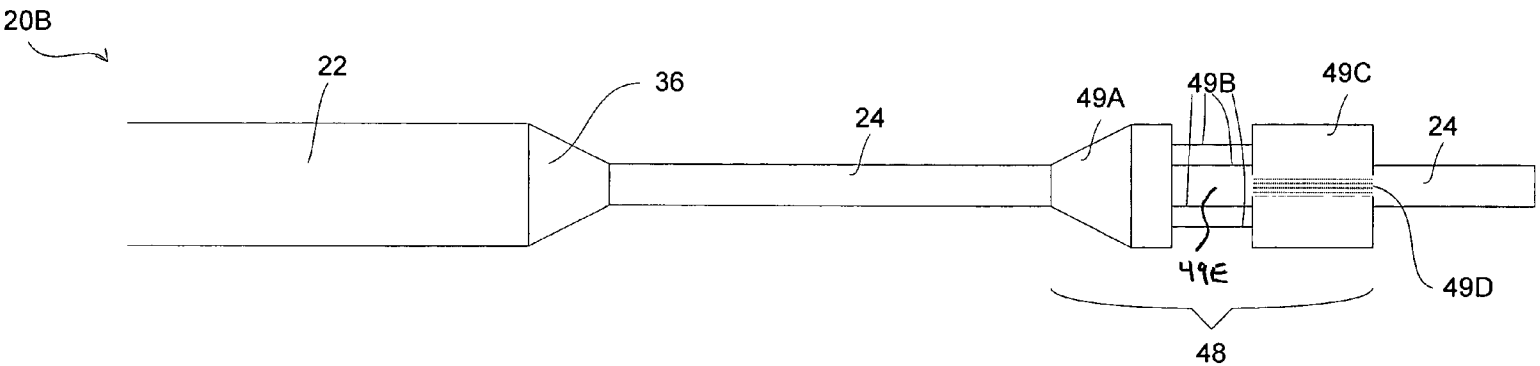
FIG. 3B illustrates a stent mandrel support in accordance with another embodiment of the invention.

FIG. 3B illustrates a stent mandrel support 20B in accordance with another embodiment of the invention. The stent mandrel support 20B is substantially similar to the stent mandrel support 20 except that the support 20B includes a collet 48 in place of the lock member 26. The collet 48 comprises a coning end portion 49A coupled to a crimp section 49C via an arm 49E. The end portion 49A, like the end 42, is cone shaped and supports the stent 10 at a second end during a coating process. The bore extends completely through the collet 48, in which the mandrel 24 travels through. The crimp section 49C can be friction fitted to the mandrel 24 or crimped onto the mandrel 24 to prevent movement of the collet 48 with respect to the mandrel 24. Cutaway segments 49B and 49D enable the crimp section 49C to be easily crimped.

Figure 4A:
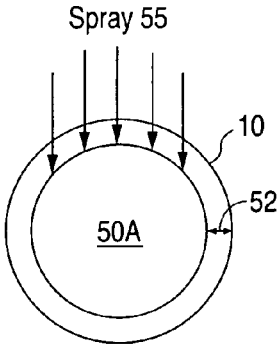
FIG. 4A, FIG. 4B, and FIG. 4C illustrate a cross section, perspective view, and top view, respectively, of a stent mandrel.
Figure 4C:
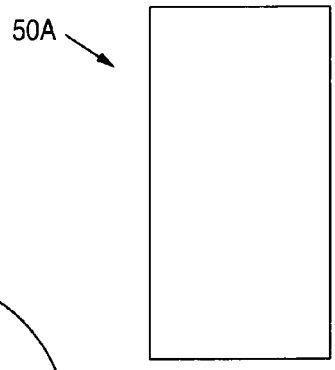
Figure 4B:
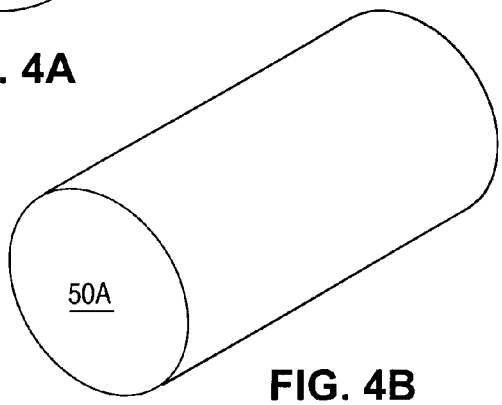

FIG. 4A, FIG. 4B. and FIG. 4C illustrate a cross section, perspective view, and top view, respectively, of a body 50A of the stent mandrel 24. The shape of this embodiment is herein after defined as "configuration 1". The body 50A (as well as 50B, 50C, 50D, 50E, 50F, and 50G—collectively "50") is the portion of the mandrel 24 that is not inserted into ends 36 and 42 during the coating process. If the mandrel 24 is used by itself, without any of the previously described elements such as the support member 22 or the lock member 26, the body 50 could be considered the mandrel 24 in and of itself. Accordingly, the body 50 could be almost as long as the length of the stent. If flat ends, instead of the coning end portions 36 and 42, are used, then the length of the body 50 would be equivalent to or the same as the length of the stent. In one embodiment, the body 50 can have a length larger than the length of the stent. In some embodiments, the length of the body 50 should be more than 25% of the length of the stent, more than 50% of the length of the stent, more than 75% of the length of the stent, or more than 90% of the length of the stent. In one embodiment, the body 50A is cylindrical in shape and has a diameter slightly less than an inner diameter of the stent 10. In an embodiment of the invention, the diameter of the body 50A can be about 1.35 mm to about 1.4 mm less than the inner diameter of the stent 10 as indicated by distance 52. Note that the distance 52 is critical as too short a distance between the stent 10 and the body 50A may cause the spray composition 55 to wick underneath the stent struts and/or may form a film between the stent struts. Either way, this may cause the stent 10 to be stuck to the mandrel body 50A, which can lead to coating defects when the stent 10 is removed from the mandrel support 20. Too large a distance 52 will lead to coating of the luminal surface of the stent 10. The proper distance does, in part, depend on the type of composition used and one having ordinary skill on the art can easily calibrate the distance.

During a coating process, a sprayed composition 55 is sprayed onto the stent 10. The spray composition 55 impacts and coats the abluminal surface of the stent 10. In addition, some of the spray composition 55 passes through the gaps of the scaffolding network and impacts the body 50A, which acts to block the spray composition 55 from impacting, and therefore coating, the luminal surface of the stent 10.

The components of the coating substance or composition 55 can include a solvent or a solvent system comprising multiple solvents; a polymer or a combination of polymers; and optionally a therapeutic substance or a drug or a combination of drugs.

Representative examples of polymers that can be used to coat a stent or medical device include ethylene vinyl alcohol copolymer (commonly known by the generic name EVOH or by the trade name EVAL); poly(hydroxyvalerate); poly(L-lactic acid); polycaprolactone; poly(lactide-co-glycolide); poly(glycerol-sebacate); poly(hydroxybutyrate); poly(hydroxybutyrate-co-valerate); polydioxanone; polyorthoester; polyanhydride; poly(glycolic acid); poly(D,L-lactic acid); poly(glycolic acid-co-trimethylene carbonate); polyphosphoester; polyphosphoester urethane; poly(amino acids); cyanoacrylates; poly(trimethylene carbonate); poly(iminocarbonate); copoly(ether esters) (e.g. PEO/PLA); polyalkylene oxalates; polyphosphazenes; biomolecules, such as fibrin, fibrinogen, cellulose, starch, collagen and hyaluronic acid; polyurethanes; silicones; polyesters; polyolefins; polyisobutylene and ethylene-alphaolefin copolymers; acrylic polymers and copolymers; vinyl halide polymers and copolymers, such as polyvinyl chloride; polyvinyl ethers, such as polyvinyl methyl ether; polyvinylidene halides, such as polyvinylidene fluoride and polyvinylidene chloride; polyacrylonitrile; polyvinyl ketones; polyvinyl aromatics, such as polystyrene; polyvinyl esters, such as polyvinyl acetate; copolymers of vinyl monomers with each other and olefins, such as ethylene-methyl methacrylate copolymers, acrylonitrilestyrene copolymers, ABS resins, and ethylene-vinyl acetate copolymers; polyamides, such as Nylon 66 and polycaprolactam; alkyd resins; polycarbonates; polyoxymethylenes; polyimides; polyethers; epoxy resins; polyurethanes; rayon; rayon-triacetate; cellulose; cellulose acetate; cellulose butyrate; cellulose acetate butyrate; cellophane; cellulose nitrate; cellulose propionate; cellulose ethers; and carboxymethyl cellulose.

"Solvent" is defined as a liquid substance or composition that is compatible with the polymer and is capable of dissolving the polymer at the concentration desired in the composition. Examples of solvents include, but are not limited to, dimethylsulfoxide, chloroform, acetone, water (buffered saline), xylene, methanol, ethanol, 1-propanol, tetrahydrofuran, 1-butanone, dimethylformamide, dimethylacetamide, cyclohexanone, ethyl acetate, methylethylketone, propylene glycol monomethylether, isopropanol, isopropanol admixed with water, N-methylpyrrolidinone, toluene, and mixtures and combinations thereof.

The therapeutic substance or drug can be for inhibiting the activity of vascular smooth muscle cells. More specifically, the active agent can be aimed at inhibiting abnormal or inappropriate migration and/or proliferation of smooth muscle cells for the inhibition of restenosis. The drug can also include any substance capable of exerting a therapeutic or prophylactic effect. For example, the agent can be for enhancing wound healing in a vascular site or improving the structural and elastic properties of the vascular site. Examples of agents include antiproliferative substances such as actinomycin D, or derivatives and analogs thereof (manufactured by Sigma-Aldrich 1001 West Saint Paul Avenue, Milwaukee, Wis. 53233; or COSMEGEN available from Merck). Synonyms of actinomycin D include dactinomycin, actinomycin IV, actinomycin $I_1$, actinomycin $X_1$, and actinomycin $C_1$. The active agent can also fall under the genus of antineoplastic, antiinflammatory, antiplatelet, anticoagulant, antifibrin, antithrombin, antimitotic, antibiotic, antiallergic and antioxidant substances. Examples of such antineoplastics and/or antimitotics include paclitaxel (e.g. TAXOL® by Bristol-Myers Squibb Co., Stamford, Conn.), docetaxel (e.g. Taxotere®, from Aventis S.A., Frankfurt, Germany) methotrexate, azathioprine, vincristine, vinblastine, fluorouracil, doxorubicin hydrochloride (e.g. Adriamycin® from Pharmacia & Upjohn, Peapack N.J.), and mitomycin (e.g. Mutamycin® from Bristol-Myers Squibb Co., Stamford, Conn.). Examples of such antiplatelets, anticoagulants, antifibrin, and antithrombins include sodium heparin, low molecular weight heparins, heparinoids, hirudin, argatroban, forskolin, vapiprost, prostacyclin and prostacyclin analogues, dextran, D-phe-pro-arg-chloromethylketone (synthetic antithrombin), dipyridamole, glycoprotein IIb/IIIa platelet membrane receptor antagonist antibody, recombinant hirudin, and thrombin inhibitors such as Angiomax™ (Biogen, Inc., Cambridge, Mass.). Examples of such cytostatic or antiproliferative agents include angiopeptin, angiotensin converting enzyme inhibitors such as captopril (e.g. Capoten® and Capozide® from Bristol-Myers Squibb Co., Stamford, Conn.), cilazapril or lisinopril (e.g. Prinivil® and Prinzide® from Merck & Co., Inc., Whitehouse Station, N.J.); calcium channel blockers (such as nifedipine), colchicine, fibroblast growth factor (FGF) antagonists, fish oil (omega 3-fatty acid), histamine antagonists, lovastatin (an inhibitor of HMG-CoA reductase, a cholesterol lowering drug, brand name Mevacor® from Merck & Co., Inc., Whitehouse Station, N.J.), monoclonal antibodies (such as those specific for Platelet-Derived Growth Factor (PDGF) receptors), nitroprusside, phosphodiesterase inhibitors, prostaglandin inhibitors, suramin, serotonin blockers, steroids, thioprotease inhibitors, triazolopyrimidine (a PDGF antagonist), and nitric oxide. An example of an antiallergic agent is permirolast potassium. Other therapeutic substances or agents which may be appropriate include alpha-interferon, genetically engineered epithelial cells, dexamethasone, rapamycin, and structural derivatives and functional analogues of rapamycin.

Figure 5A:
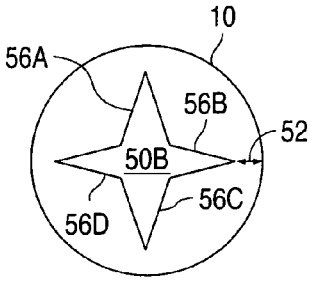
FIG. 5A, FIG. 5B, FIG. 5C, and FIG. 5D illustrate a cross section, perspective view, top view, and a preassembled view, respectively, of a stent mandrel according to another embodiment of the invention.
Figure 5C:
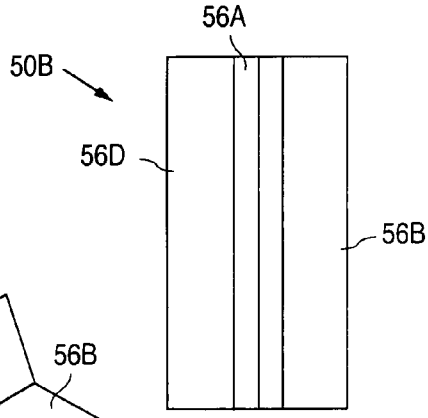
Figure 5B:
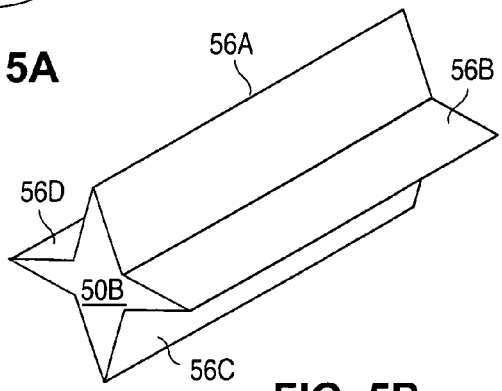
Figure 5D:
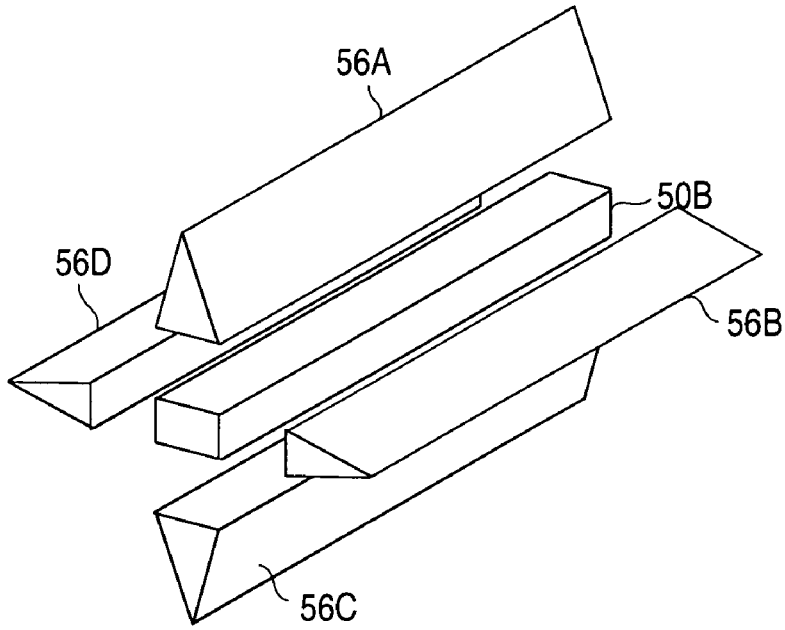

FIG. 5A, FIG. 5B, and FIG. 5C illustrate a cross section, perspective view, and top view, respectively, of a body 50B of the stent mandrel 24. The shape illustrated by FIG. 5A, FIG. 5B, and FIG. 5C is defined hereinafter as "configuration 2." The cross section of body 50B at any cut along the length of the body 50B is in the shape of a 4-point star having 4 spines or spikes 56A, 56B, 56C, and 56D. The spikes 56A-56D, each defined by a pair of converging walls or sides so as to have a triangular shape, are evenly spaced within the circumference of the stent 10 (for example, at 90 degree intervals). Each spike 56A-56D converges with the adjacent spike at an angle; however, a curved transition between adjacent sides of neighboring spikes can also be provided. The body 50B, like the body 50A, acts to block the luminal surface of the stent 10 from being coated by the spray composition 55. The outer most point of the body 50B (i.e., the tip of a spike 56) is separated from the inner surface of the stent 10 by about a distance of 1.35 mm to about 1.4 mm, as indicated by the distance 52. The body 50B may be advantageous over the body 50A as the body 50B limits the possibility of stent 10/body 50B contact to only the points of the star shape instead of the full circumference of the cylinder shape of the body 50A. If there is any contact between the stent 10 and the spikes 56A-56D, the contact area will only be along a line corresponding to the length of the peak of one or more of the spikes 56A-56D, thereby limiting sticking and the potential for defect formation. If a coating defect is formed, it will be limited to the line and can be fixed through subsequent coating or processing applications. It will be appreciated by one of ordinary skill in the art that the body 50B can include a minimum of three spikes or have additional spikes. The body 50B can be made by etching, laser or carving of a single solid piece of material. Alternatively, as illustrated by FIG. 5D, an elongated core piece having a rectangular or square cross section can be provided and spikes 56A-56D can be coupled by an adhesive or soldering to each of the four circumferential sides of the core piece.

Figure 6A:
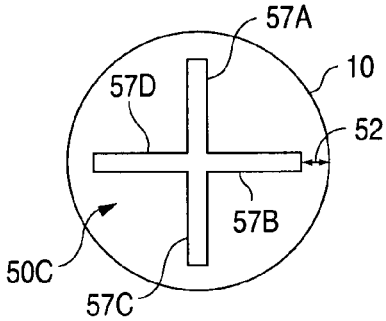
FIG. 6A, FIG. 6B, and FIG. 6C illustrate a cross section, perspective view, and top view, respectively, of a stent mandrel according to another embodiment of the invention.
Figure 6C:
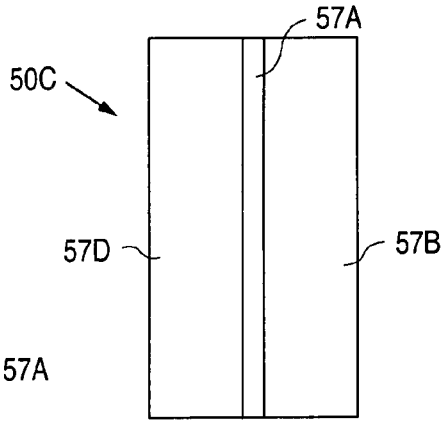
Figure 6B:
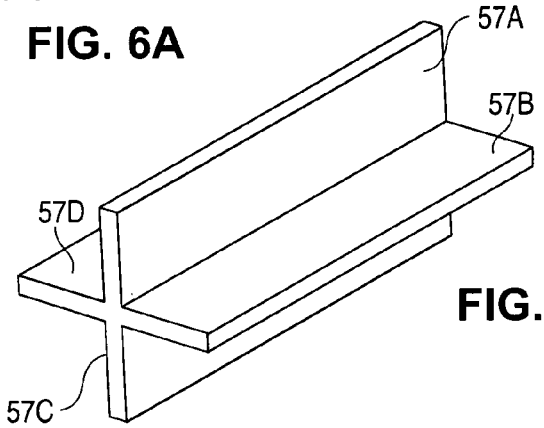

In another embodiment, a body 50C can have configuration as shown in FIG. 6A-FIG. 6C. FIG. 6A illustrate a "+" shaped cross sectional configuration made of 4 rectangular walls 57A, 57B, 57C and 57D converging at one end and each separated by 90° form the adjacent wall. If 4 walls are used, the angle of convergence between two of the wall can be less than 90° so as to provide an "X" shaped cross sectional configuration. The "+" and "X" shape are defined hereinafter as "configuration 3."

Figure 7D:
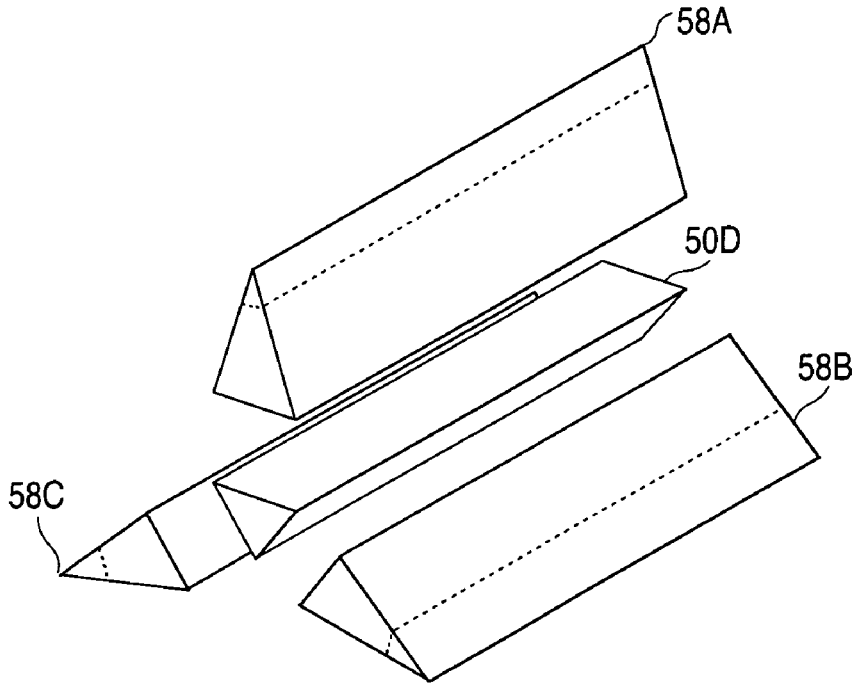
FIG. 7A, FIG. 7B, FIG. 7C, and FIG. 7D illustrate a cross section, perspective view, top view, and preassembled view, respectively, of a stent mandrel according to another embodiment of the invention.
Figure 7A:
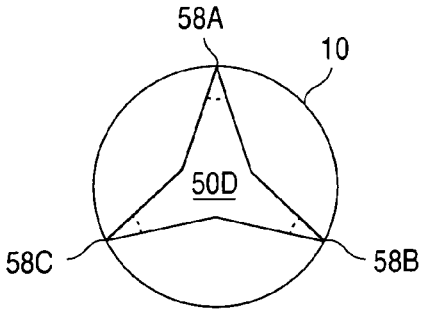
Figure 7C:
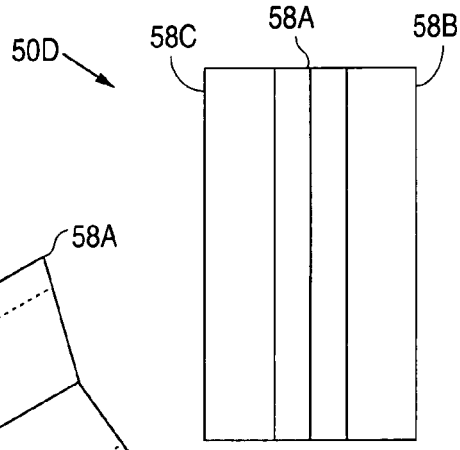
Figure 7B:
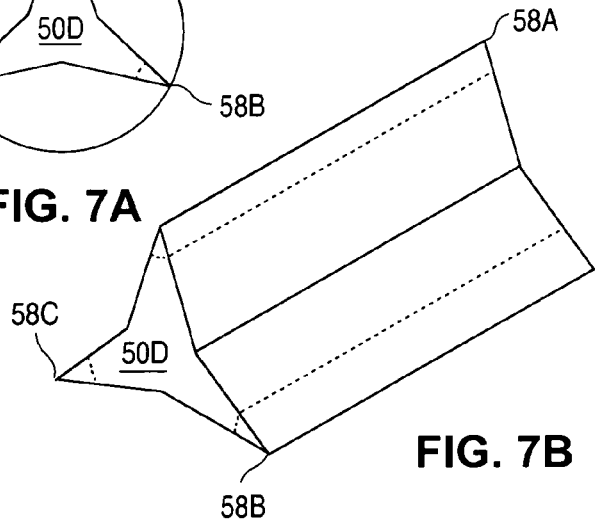

FIG. 7A, FIG. 7B. and FIG. 7C illustrate a cross section, perspective view, and top view, respectively, of a body 50D of the stent mandrel 24 in accordance with yet another embodiment of the invention. The body 50D has a shape of a 3-point star, i.e., the body 50D has three spikes 58A, 58B, and 58C. A side of each spike 58 converges at an angle with the adjacent side of its neighboring spike 58. The spikes 58A, 58B and 58C are spaced in even intervals within the circumference of the stent 10 (i.e., at 120 degree intervals). The body 50D can be made from a single solid piece or can be made from, as illustrated by FIG. 7D, a elongated core section having a triangular cross section such that the spikes 58A-58C are attached or coupled to each side of the core section. The shape provided by FIGS. 7A-7D is defined herein after as "configuration 4."

It should be noted that in some embodiments the mandrel 24 or the body 50 can contact the inner stent surface. As best illustrated by FIG. 7A, spikes 58A-58C of the body 50D touch and support the luminal surface of the stent 10, thereby obviating the need for the ends 36 and 42 to be cone-shaped to support the stent 10. In the embodiment were body 50 makes contact with the inners surface of the stent, the body may be coated with or made of a non-stick material such as poly (tetrafluor ethylene) (e.g., Teflon®). Alternative materials such as fluorinated ethylene propylene ("FEP"), poly (vinylidene fluoride) ("PVDF"), poly (para-xylyene), polyamide (Nylon), polyolefins (e.g., high density poly (ethylene) and poly (propylene)), or polyacetal (DELRIN®) can also be used, depending on the coating composition employed. The polymeric material can prevent or reduce the formation of clumps or other defects along the point of contact between the stent 10 and the support.

Figure 8A:
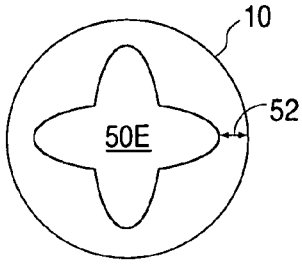
FIG. 8A, FIG. 8B, and FIG. 8C illustrate a cross section, perspective view, and top view, respectively, of a stent mandrel according to another embodiment of the invention.
Figure 8C:
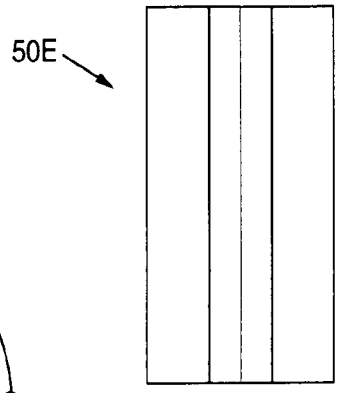
Figure 8B:
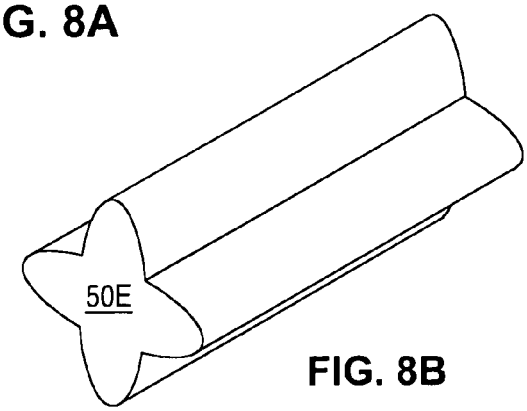

In lieu of spike shaped walls forming a "star" shaped cross section, the spikes could be curved such that the cross section of the body 50 would resemble a 4 leaf clover, as depicted in FIG. 8A-FIG. 8C. The entire wall could be curved (as illustrated) or the wall can include 2 parallel sides having a curved end. These shapes are defined as "configuration 5." The radius of curvature of the walls, more particularly the end of the walls, can be less than the radius of curvature of the stent so as to provide for minimum contact between the mandrel 24 and the stent. The body 50E is similar in form and function to the body 50B and therefore has similar advantages over the body 50A. It will be appreciated by one of ordinary skill in the art that the body 50E can have 3 leaves or more than 4 leaves.

Figure 9A:
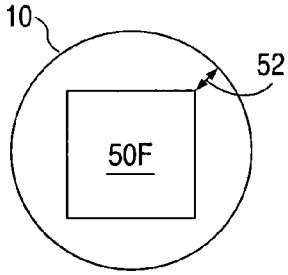
FIG. 9A, FIG. 9B, and FIG. 9C illustrate a cross section, perspective view, and top view, respectively, of a stent mandrel according to another embodiment of the invention.
Figure 9C:
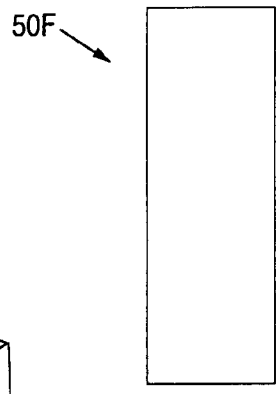
Figure 9B:
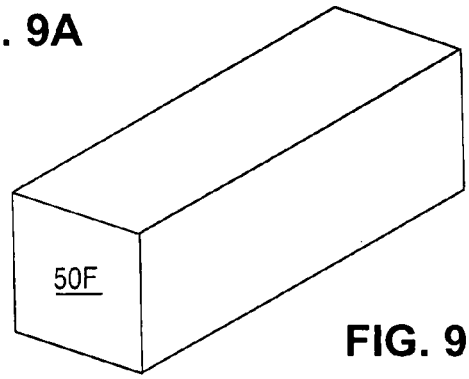

FIG. 9A, FIG. 9B, and FIG. 9C illustrate a cross section, perspective view, and top view, respectively, of a section 50F of the stent mandrel 24 according to another embodiment of the invention. This shape is defined as "configuration 6." Body 50F is an elongated cubical shaped mandrel having a square or rectangular cross sectional configuration. In one embodiment, the longest diagonal of the cross section (the measurement from one corner to the opposing corner) can be smaller that the inner diameter of the stent 10 so as to provide a distance 52 between a corner of the section 50F and the luminal surface of the stent 10.

Figure 10A:
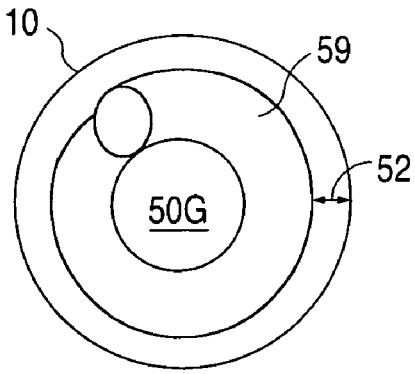
FIG. 10A, FIG. 10B, and FIG. 10C illustrate a cross section, perspective view, and top view, respectively, of a stent mandrel according to another embodiment of the invention.
Figure 10B:
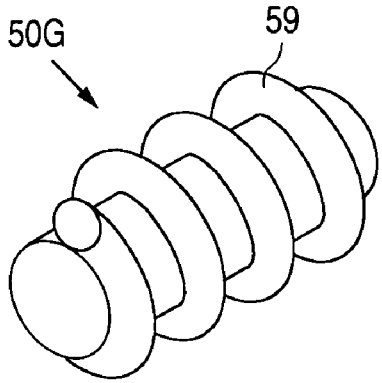
Figure 10C:
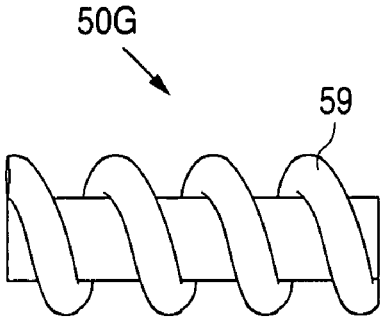

FIG. 10A, FIG. 10B, and FIG. 10C illustrate a cross section, perspective view, and top view, respectively, of a section 50G of the stent mandrel support 24 according to yet another embodiment of the invention. The section 50G includes a wall 59 that wraps around a core of the mandrel in a spiral or cork-screw like fashion. The wall 59 can be in contact with the inner surface of the stent 10. Alternatively, the mandrel can be designed so that there is minimal distance between the wall 59 and the inner surface of the stent 10. The wall 59 can be partially wrapped around the core or can be wrapped more than once all the way around the core. The wall 59 need not be continuous as illustrated by FIG. 10B. The wall 59 can be cylindrical in shape or plate-like. All these shapes are defined as "configuration 7."

Figure 11A:
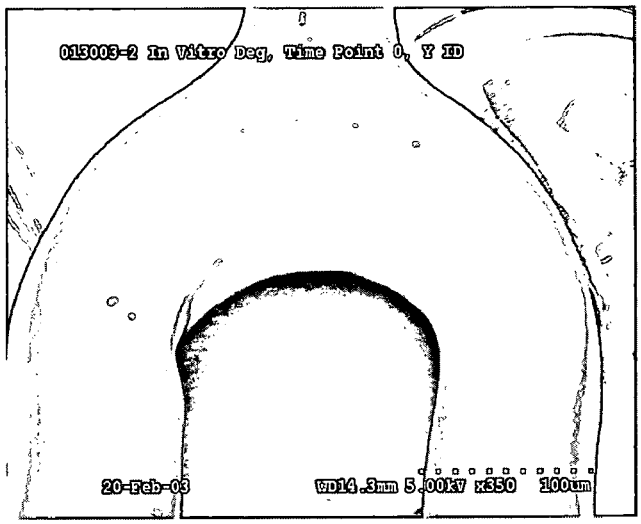
FIG. 11A, FIG. 11B and FIG. 11C illustrate the resulting luminal surface coating of stents after a conducted experiment using a conventional stent mandrel support, a stent mandrel support with a mandrel diameter of 0.061 inches, and a stent mandrel support with a mandrel diameter of 0.0625 inches, respectively.
Figure 11B:
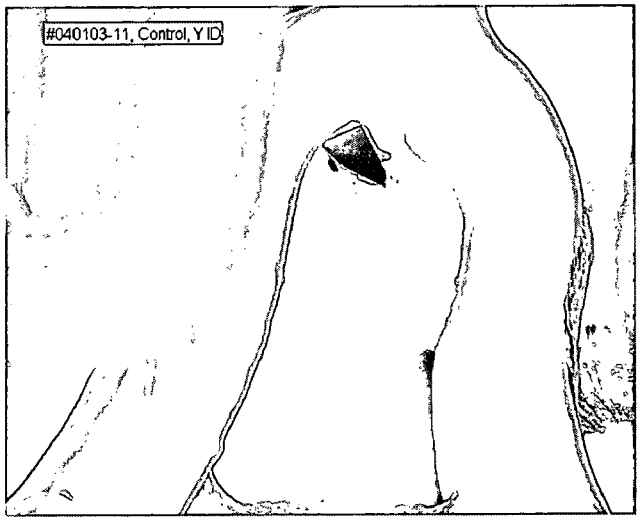
Figure 11C:
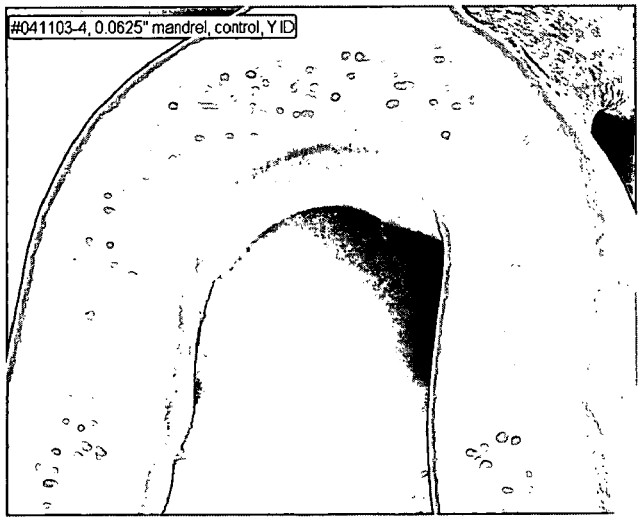

FIG. 11A, FIG. 11B and FIG. 11C illustrate the resulting luminal surface coating of stents after a conducted experiment using a conventional stent mandrel support, a stent mandrel support with section 50A diameter of 0.061 inches, and a stent mandrel support with a section 50A diameter of 0.0625 inches, respectively.

In the conducted experiment, the process parameters are listed in Table I below. PEA Benzyl Ester (300 μg) was coated onto 12 mm small VISION stents (available from Guidant Corp.) from a 2 wt % PEA Benzyl Ester in ethanol (200 proof) formulation. Coating flow rates were approximately 20 μg/pass. The stents were oven baked at 50° C. for 1 hour. Results indicated that the abluminal stent coatings were not affected using a stent mandrel support having a section 50A with diameter of 0.061 and 0.0625 inches. However, luminal stent coating was significantly reduced as the diameter of the section 50A is increased. The larger diameter pin was able to "shield" the inner diameter stent surface from much of the atomized spray solution. FIG. 11A, 11B, and 11C provides a qualitative overview of the inner diameter coating thickness reduction observed when the inventive mandrels are implemented.

TABLE I

Process parameters for spray coating PEA Benzyl Ester.

| Parameter | Set Value | Units |
|---|---|---|
| Spray Head | | |
| Spray nozzle temperature | Ambient | ° C. |
| Atomization pressure (non-activated) | 15 ± 2.5 | psi |
| Distance from spray nozzle to mandrel pin | 15 | mm |
| Solution barrel pressure | 2-3 | psi |
| Needle valve lift pressure | 80 ± 10 | psi |
| Relative humidity near spray head | <45 | % |
| Heat Nozzle | | |
| Temperature | 80 | ° C. |
| Air Pressure | 12-15 | psi |
| Distance from heat nozzle to mandrel pin | 10-15 | mm |

While particular embodiments of the present invention have been shown and described, it will be obvious to one of ordinary skill in the art that changes and modifications can be made without departing from this invention in its broader aspects. For example, after application of the coating to the abluminal surface of the stent 10 as described above, the luminal surface of the stent 10 can be coated with a different coating via spray coating, electroplating or other technique. Therefore, the appended claims are to encompass within their scope all such changes and modifications as fall within the true spirit and scope of this invention.

What is claimed is:

1. A stent and a stent mandrel support supporting the stent, the stent comprising a plurality of struts, the support comprising:

a first member to contact a first end of the stent;

a second member to contact a second end of the stent; and a third member connecting the first member to the second member and extending through a longitudinal bore of the stent, the third member shaped and/or sized to eliminate or substantially prevent a coating from being formed on a luminal surface of the stent during application of a coating substance to the stent.

2. The stent and support of claim 1, wherein the third member is cylindrical in shape.

3. The stent and support of claim 2, wherein the outer diameter of the third member is about 1.35 mm to about 1.4 mm less than the inner diameter of the stent as positioned on the support.

4. The stent and support of claim 1, wherein the third member has a plurality of spikes.

5. The stent and support of claim 4, wherein the plurality of spikes contact the luminal surface of the stent.

6. The stent and support of claim 4, wherein the plurality of spikes do not contact the luminal surface of the stent.

7. The stent and support of claim 1, wherein the cross section of the third member is star shaped.

8. The stent and support of claim 1, wherein the cross section of the third member is "+" or "X" shaped.

9. A stent and a mandrel supporting the stent, the stent comprising a plurality of struts having abluminal surfaces and luminal surfaces in fluid communication through at least a pair of the plurality of struts, the mandrel comprising: a member to penetrate at least partially into a longitudinal bore of the stent during the application of a coating substance to the stent, the member including outward projecting walls, the length of at least one of the walls being not less than 25% of the length of the stent; wherein a cross section of at least one of the walls is triangular in shape.

10. The stent and mandrel of claim 9, wherein the length of the wall is not less than 50% of the length of the stent.

11. The stent and mandrel of claim 9, wherein the length of the wall is equal to or greater than the length of the stent.

12. A stent and a mandrel supporting the stent, the stent comprising a plurality of struts having abluminal surfaces and luminal surfaces in fluid communication through at least a pair of the plurality of struts, the mandrel comprising: a member penetrating at least partially into a longitudinal bore of the stent during the application of a coating substance to the stent, the member including 6 non-parallel sides.

13. A stent and a mandrel supporting the stent, the stent comprising a plurality of struts having abluminal surfaces and luminal surfaces in fluid communication through at least a pair of the plurality of struts, the mandrel comprising: a core section having at least three sides and a wall extending from each of the sides in an outwardly direction.

14. The stent and mandrel of claim 13, wherein the walls are triangular in cross section, are square in cross section or have a curved shape.

15. The stent and mandrel of claim 13, wherein the cross section of the core has a shape of a square, triangle, or rectangle.

16. A stent and a mandrel supporting the stent, the stent comprising a plurality of struts having abluminal surfaces and luminal surfaces in fluid communication through at least a pair of the plurality of struts, the mandrel comprising: a member penetrating at least partially into a longitudinal bore of the stent during the application of a coating substance to the stent, the member including outwardly projecting walls disposed around the circumference of the mandrel, wherein each of the walls converge with its neighboring wall at an angle.

* * * * *